US011498243B2

(12) United States Patent
Winterfjord et al.

(10) Patent No.: US 11,498,243 B2
(45) Date of Patent: Nov. 15, 2022

(54) TILE OR MASONRY SAW DUST COLLECTION ARRANGEMENT

(71) Applicant: HUSQVARNA AB, Huskvarna (SE)

(72) Inventors: Olof Winterfjord, Västra Frölunda (SE); Karl Elmestrand, Sävedalen (SE)

(73) Assignee: HUSQVARNA AB, Huskvarna (SE)

( * ) Notice: Subject to any disclaimer, the term of this patent is extended or adjusted under 35 U.S.C. 154(b) by 610 days.

(21) Appl. No.: 16/484,481

(22) PCT Filed: Jan. 10, 2018

(86) PCT No.: PCT/SE2018/050016
§ 371 (c)(1),
(2) Date: Aug. 8, 2019

(87) PCT Pub. No.: WO2018/147776
PCT Pub. Date: Aug. 16, 2018

(65) Prior Publication Data

US 2020/0094438 A1 Mar. 26, 2020

(30) Foreign Application Priority Data

Feb. 13, 2017 (SE) ..... 1750129-7

(51) Int. Cl.
*B28D 1/04* (2006.01)

(52) U.S. Cl.
CPC ..... *B28D 1/047* (2013.01)

(58) Field of Classification Search
CPC ..... B28D 1/047
(Continued)

(56) References Cited

U.S. PATENT DOCUMENTS 2,394,556 A * 2/1946 Martin ..... B24B 55/06 29/DIG. 60
4,253,362 A 3/1981 Olson
(Continued)

FOREIGN PATENT DOCUMENTS

CN 2534009 Y 2/2003
CN 104249399 A 12/2014
(Continued)

OTHER PUBLICATIONS

Multiquip, "Precision cutting performance on concrete, Masonry, Stone and Ceramic Tiles", retrieved from URL: http://www.multiquip.com/multiquip/pdfs/Masonry_Pro_Saws_Brochure_223535.pdf, retrieved on Nov. 8, 2019, pp. 1-6.
(Continued)

*Primary Examiner* — Joseph J Hail
*Assistant Examiner* — J Stephen Taylor
(74) *Attorney, Agent, or Firm* — Burr & Forman LLP

(57) ABSTRACT

The present disclosure relates to a tile or masonry saw assembly comprising a saw device (2) including a motor (5) arranged to run a saw blade (4) to cut a workpiece. The saw assembly also comprises a frame (3) that is arranged to support the saw device (2) and a workpiece support (15) operably coupled to the frame (2) to support the workpiece relative to the saw device (2). The saw assembly further comprises a cover assembly (6) with a cover (9) and a supporting structure (10). A front end (25) is arranged to face the saw blade (4) and an opposing rear end (26) where a dust hose attachment (11) is positioned and arranged to be connected to a vacuum dust collection arrangement. The supporting structure (10) comprises a base (16) that is arranged to be fastened to the workpiece support (15). The cover (9) is movable relative the base (16), and the cover
(Continued)

assembly (6) is releasably attachable to the workpiece support (15).

12 Claims, 12 Drawing Sheets

(58) Field of Classification Search
USPC ..... 125/14
See application file for complete search history.

(56) References Cited

U.S. PATENT DOCUMENTS

| | | | | |
|---|---|---|---|---|
| 4,572,715 | A * | 2/1986 | Wolff | B23B 47/287 408/112 |
| 4,576,072 | A | 3/1986 | Terpstra et al. | |
| 6,273,081 | B1 | 8/2001 | Gorgol et al. | |
| 7,013,884 | B2 | 3/2006 | Guth | |
| 7,451,758 | B2 | 11/2008 | Lee | |
| 7,882,771 | B2 | 2/2011 | Sasaki et al. | |
| 2002/0112582 | A1 | 8/2002 | Young | |
| 2006/0042439 | A1 | 3/2006 | Powell | |
| 2010/0307307 | A1* | 12/2010 | Butler | B23D 59/006 83/477.2 |
| 2011/0162501 | A1 | 7/2011 | Koegel et al. | |
| 2014/0013911 | A1 | 1/2014 | Matsubara | |
| 2015/0367527 | A1* | 12/2015 | Elemstrand | B28D 1/044 125/14 |

FOREIGN PATENT DOCUMENTS

| | | | |
|---|---|---|---|
| DE | 102008009113 | B4 | 2/2010 |
| EP | 2965886 | A2 | 1/2016 |
| KR | 20150112648 | A | 10/2015 |
| SE | 1500086 | A1 | 8/2016 |
| WO | 2010144627 | A2 | 12/2010 |
| WO | 2014164276 | A1 | 10/2014 |

OTHER PUBLICATIONS

Sima Machinery, "Universal construction saws Sima Handy 350", retrieved from URL: http://www.elvaprofi.cz/stavebni-technika/stavebni-stolove-pily/sima_handy-350.html, retrieved on Nov. 8, 2019, pp. 1-2.

Swedish Search Report for Application No. 1750129-7 dated Aug. 4, 2017.

International Search Report and Written Opinion for International Application No. PCT/SE2018/050016 dated Apr. 5, 2018.

International Preliminary Report on Patentability for International Application No. PCT/SE2018/050016 dated Aug. 13, 2019.

* cited by examiner

TILE OR MASONRY SAW DUST COLLECTION ARRANGEMENT

TECHNICAL FIELD

The present disclosure relates to a tile or masonry saw assembly comprising a saw device including a motor arranged to run a saw blade to cut a workpiece in a cutting direction. The saw assembly further comprises a frame that is arranged to support the saw device such that it is enabled to move relative to the frame to execute cutting operations by means of the saw blade. A workpiece support is operably coupled to the frame to support the workpiece relative to the saw device, and to allow the workpiece support to be moved along the frame.

BACKGROUND

When a user is laying bricks or other masonry workpieces, sometimes the workpieces need to be cut. Cutting may be accomplished with diamond or other cutting blades on either tile or masonry saws. The saws may be provided as a saw assembly that may include a table for supporting a workpiece to be cut and structures for manipulating the position of the saw.

Such a cutting machine may be used for cutting hard materials such as concrete or rock, where the cutting procedure may result in the creation of dust. For example concrete dust is unhealthy to breathe and also impairs visions, and it is desired to minimize the creations of such dust that freely may expand in the air. Such free concrete dust that finds its way into the engine of the tool drastically affects the engine in a negative way, may cause undesirable health effects and generally pollutes the environment.

Many tools of the above type or for this purpose equipped with a water supply, where a flow of water is directed towards the saw blade in such a way that a large quantity of the dust is mixed with the water and thus retained and kept from expanding in the air.

The flow of water is preferably held at a minimum while maintaining a proper function, since the water normally has to be taken care of at the working site, more water than necessary is undesirable. At some working sites, a demand for cleanliness, or shortage of water, results in that such a water supply is undesired. For this purpose, many types of dust removal systems of vacuum cleaner type have been developed. Some of them have an integrated fan for propelling air into a dust hose that guides undesired dust particles to a remote dust container.

U.S. Pat. No. 7,013,884 discloses a masonry saw debris collection system where a movable work workpiece support has a shroud or hood assembly extending rearwardly from the table, including a vacuum chamber acting as a primary collection point or area.

It is desirable to obtain a more versatile and easily handled table saw dust collection arrangement.

SUMMARY

It is an object of the present disclosure to provide a table saw dust collection arrangement that is more versatile and easily handled than previous such arrangements.

This object is achieved by means of a tile or masonry saw assembly comprising a saw device including a motor arranged to run a saw blade to cut a workpiece in a cutting direction. The saw assembly also comprises a frame that is arranged to support the saw device such that it is enabled to move relative to the frame to execute cutting operations by means of the saw blade, and a workpiece support operably coupled to the frame to support the workpiece relative to the saw device, and to allow the workpiece support to be moved along the frame. The saw assembly further comprises a cover assembly that has a first longitudinal extension and in turn comprises a cover and a supporting structure, and has a front end that is arranged to face the saw blade and a rear end that is arranged to face away from the saw blade. The cover assembly comprises a dust hose attachment that is positioned at the rear end and is arranged to be connected to a vacuum dust collection arrangement. The cover assembly is releasably attachable to the workpiece support, where the supporting structure comprises a base that is arranged to be attached to the workpiece support.

According to an example, the longitudinal extension is arranged to run along the cutting direction when the cover assembly is attached to the workpiece support.

According to another example, the workpiece support has a second longitudinal extension, where furthermore the base is arranged to be attached to the workpiece support by means of co-operating fastening means comprised in both the base and the workpiece support. These fastening means are intended to engage each other such that the base and the workpiece support both extend straight such that the first longitudinal extension runs parallel to the second longitudinal extension when the base is attached to the workpiece support.

According to another example, the base comprises first fastening means and that the workpiece support comprises second fastening means, where the respective co-operating first fastening means and second fastening means comprises at least one of:

- One or more guiding pins and one or more apertures arranged to be engaged by said guiding pins.
- At least one resilient tongue part and at least one plate that is arranged to be engaged engage by said tongue part.
- Grooves and slide holders, where the slide holders are arranged to slide in the grooves.
- Longitudinally extending rods and longitudinally extending grooves, where each rod comprises a lowered hook part that is arranged to be inserted in an opening at the end of the groove.
- Longitudinally protruding hook members and indents, where the hook members are intended to be inserted into the indents.

This object is also achieved by means of a tile or masonry saw assembly comprising a saw device including a motor arranged to run a saw blade to cut a workpiece in a cutting direction. The saw assembly also comprises a frame that is arranged to support the saw device such that it is enabled to move relative to the frame to execute cutting operations by means of the saw blade, and a workpiece support operably coupled to the frame to support the workpiece relative to the saw device, and to allow the workpiece support to be moved along the frame. The saw assembly further comprises a cover assembly that has a first longitudinal extension and in turn comprises a cover and a supporting structure, and has a front end that is arranged to face the saw blade and a rear end that is arranged to face away from the saw blade. The cover assembly further comprises a dust hose attachment that is positioned at the rear end and is arranged to be connected to a vacuum dust collection arrangement. The supporting structure comprises a base that is arranged to be fastened to the workpiece support, where the cover is movable relative the base in the first longitudinal extension along the cutting direction.

According to another example, the cover assembly comprises telescopically extendable rail sections that are attached to the cover and to a rail section holder that is attached to the base, where the cover is attached, these rail sections enabling the cover to move relative the base.

The present disclosure confers a plurality of advantages. Mainly, a table saw dust collection arrangement is provided that is more versatile and easily handled than previous such arrangements. The present disclosure enables a wet cutting saw assembly to be easily configured for dry cutting. The present disclosure also provides a cover assembly that is adjustable for different types of workpieces having different sizes, enabling a maximized degree of dust collection to be obtained for the present workpiece

BRIEF DESCRIPTION OF THE DRAWINGS

The present disclosure will now be described more in detail with reference to the accompanying figures wherein.

DETAILED DESCRIPTION

Figure 1:
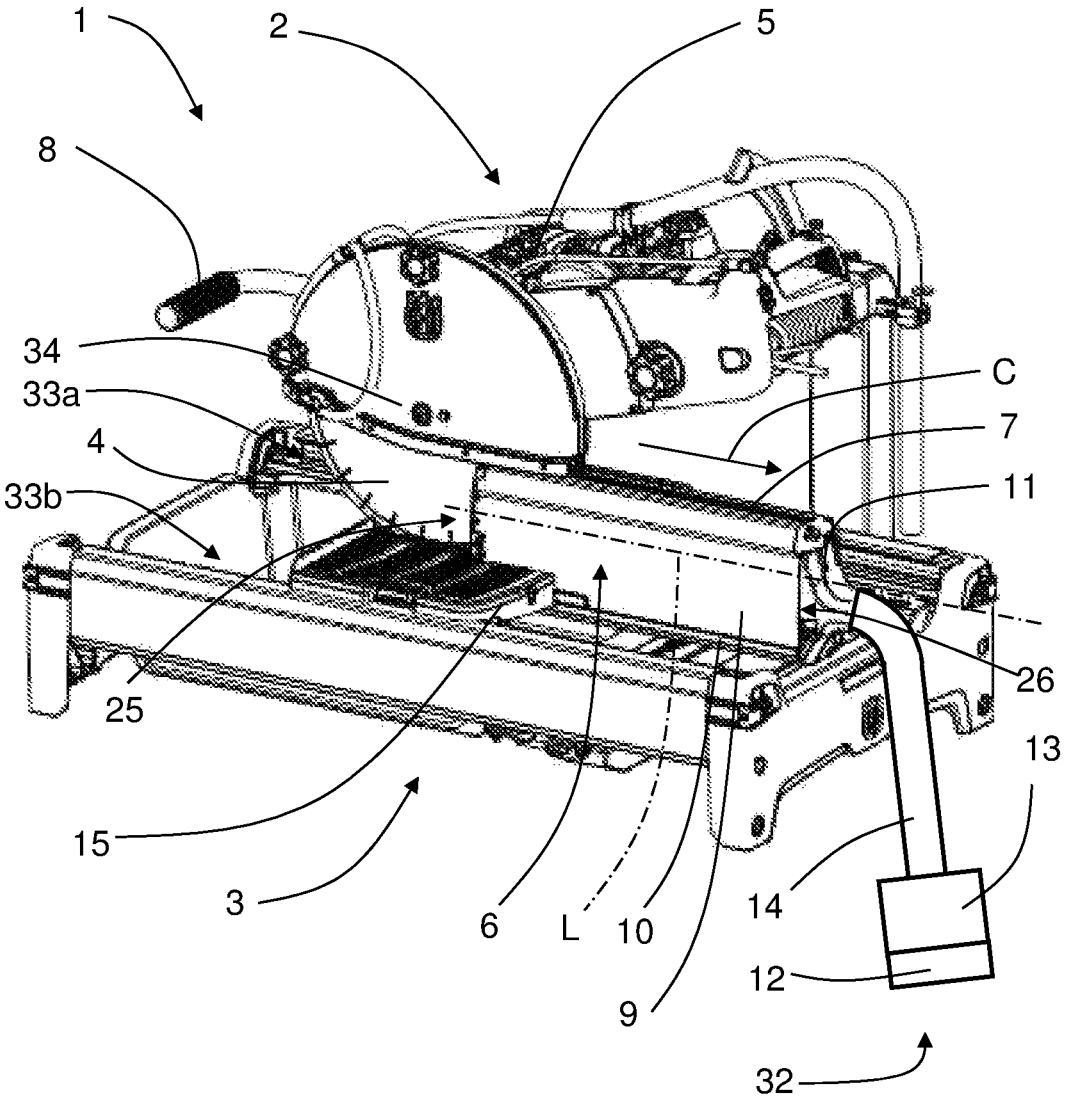
FIG. 1 shows a perspective view of a saw device in a first state.
Figure 2:
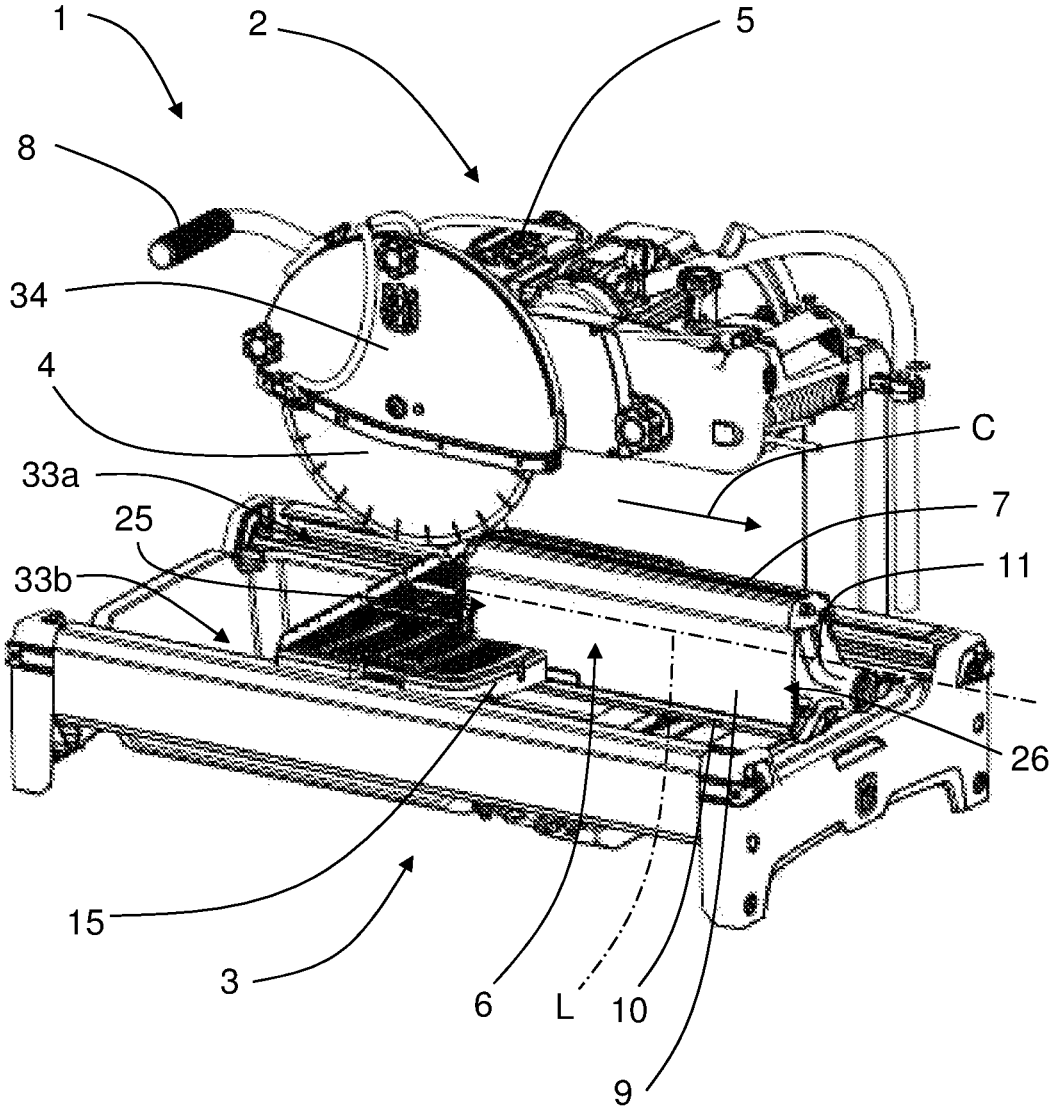
FIG. 2 shows a perspective view of a saw device in a second state.

As shown in FIG. 1, a there is a tile or masonry saw assembly 1 that comprises a saw device 2 and a frame 3. With reference also to FIG. 2, showing the saw device 2 in a raised position relative the position shown in FIG. 1, the frame 3 supports the saw device 2 such that it is enabled to move relative to the frame 3 to execute cutting operations by means of a saw blade 4 included in the saw device 2. For lowering and raising the saw device 2, the saw device 2 comprises a handle 8. The saw blade 4 is partially covered by a saw blade cover 34.

The saw device 2 further includes a motor 5 that is operable responsive to selective application of power from a power source, and that is configured to power and run the saw blade 4 to cut a workpiece, such as for example a tile, a stone, a brick, a piece of concrete or other such construction materials, in a cutting direction (C). Based on the power source employed, the motor 5 may be, for example, either electric powered or gasoline/petrol powered. The saw assembly 1 further comprises a workpiece support 15 onto which the workpieces are intended to be positioned when they are to be cut by means of the saw blade 4. The workpiece support 15 is movably carried by the frame 3.

Figure 4:
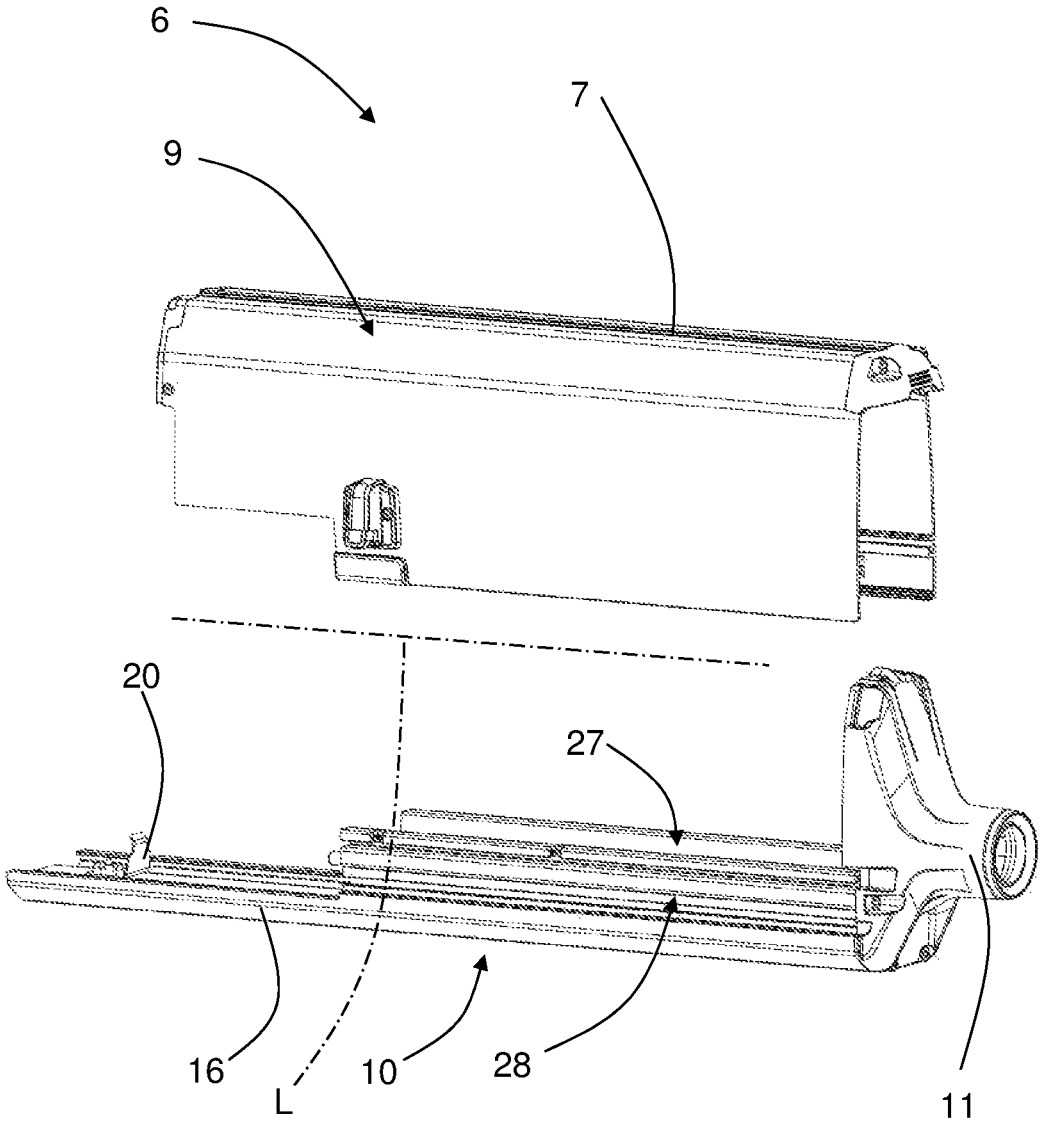
FIG. 4 shows a perspective view of a cover assembly where a cover is separated from a supporting structure.
Figure 5:
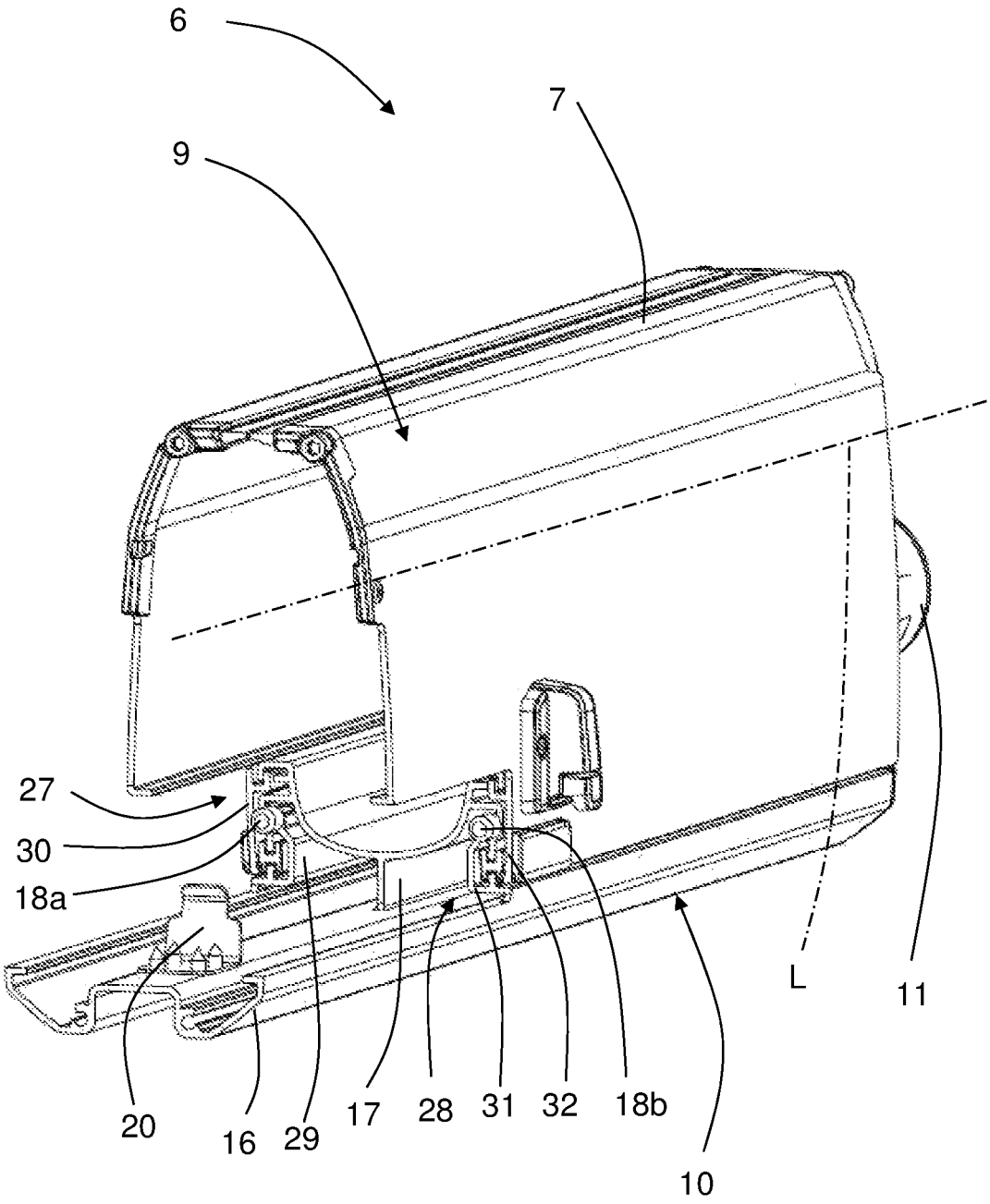
FIG. 5 shows a perspective view of a cover assembly.

With reference also to FIG. 4 and FIG. 5, the saw assembly 1 comprises a cover assembly 6 that has a first longitudinal extension L along the cutting direction C, where the saw blade 4 is arranged to run in a slot 7 in the cover assembly 6, where the slot 7 is extending in the first longitudinal extension L. The cover assembly 6 has a front end 25 that is facing the saw blade 4 and a rear end 26 that is facing away from the saw blade 4. The cover assembly 6 comprises a cover 9 and a supporting structure 10, where FIG. 4 shows the cover 9 separated from the supporting structure 10, and where FIG. 5 shows the cover 9 mounted to the supporting structure 10.

A dust hose attachment 11 is positioned at the supporting structure 10, at the rear end 26. The dust hose attachment 11 is arranged to be connected to a dust hose or similar. As shown only in FIG. 1, for reasons of clarity, a fan device 12 is arranged to convey air from the dust hose attachment 11 into a dust container 13 via a dust hose 14 such that dust that is created during sawing is collected in the cover assembly 6, inside the cover 9, and is propelled from the cover assembly 6 to the dust container 13. The dust hose 14, the dust container 13 and the fan device 12 in the described configuration is one example of a vacuum dust collection arrangement 32. A vacuum dust collection arrangement may of course be configured in many other ways that are well-known in the art.

With reference to FIG. 1-FIG. 8, the supporting structure 10 comprises a base 16 that is intended to be fastened to the workpiece support 15.

Figure 3:
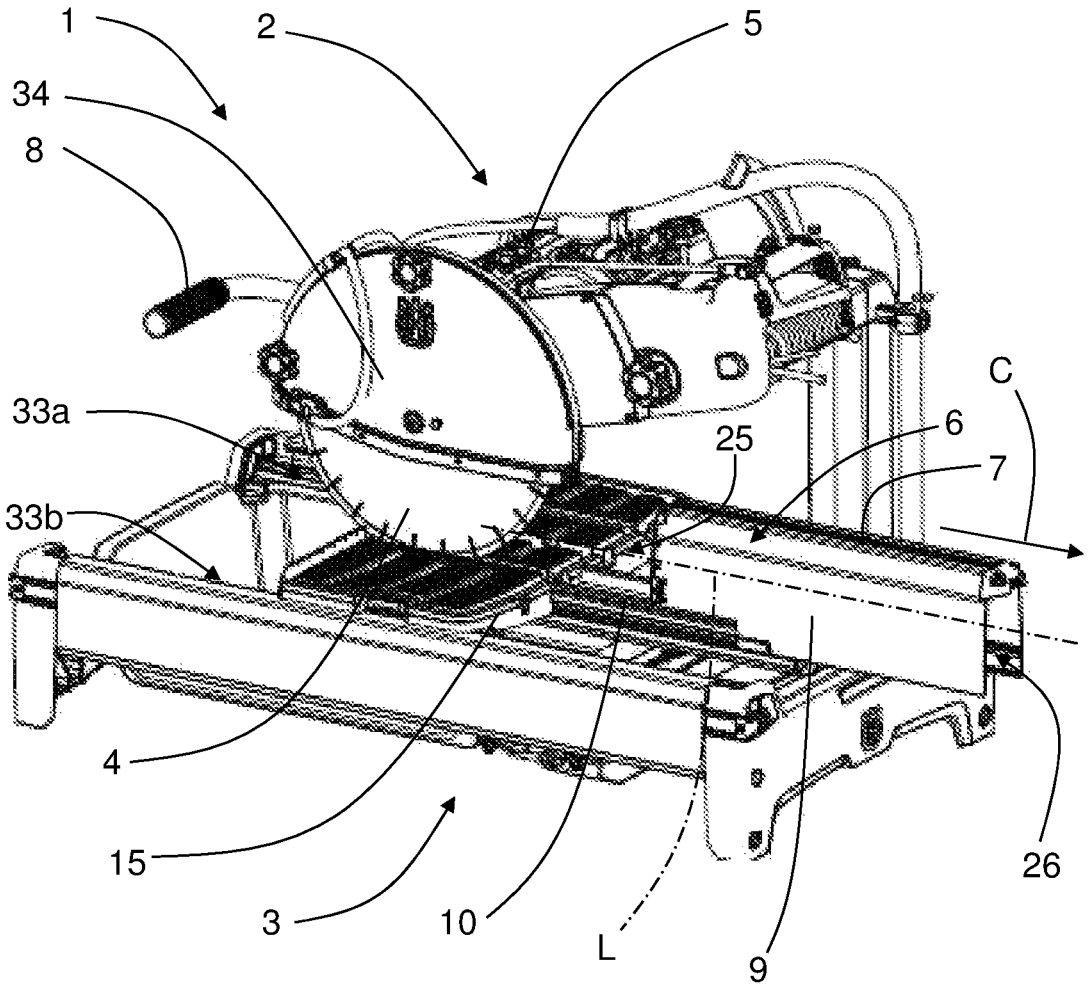
FIG. 3 shows a perspective view of a saw device in a third state.

According to the present disclosure, as especially shown in FIG. 1 and FIG. 3, the cover 9 is movable relative the base 16 in the first longitudinal extension L. When the supporting structure 10 is attached to the workpiece support 15. the cover 9 is thus movable relative the workpiece support 15 as well, and adjustable for different types of workpieces having different sizes, enabling a maximized degree of dust collection to be obtained for the present workpiece. As shown in FIG. 3, the cover 9 is moved past the dust hose attachment 11 at the rear end 26, such that the dust hose attachment 11 is covered by the cover 9 and thus not visible in FIG. 3. The cover 9 is thus moved past the rear end 26, which in practice is rearmost at the cover assembly 6 only in dependence of the longitudinal position of the cover 9. The denomination rear end 26 is thus not to be interpreted as always being a literal rear end of the cover assembly 6, since the cover 9 can be moved past the rear end 26.

To accomplish this, the supporting structure 10 comprises telescopically extendable rail sections 27, 28 onto which the cover 9 is attached, these rail sections 27, 28 enabling the cover 9 to move relative the base 16. There is one rail section 27, 28 on each side of the cover assembly 6, running in the first longitudinal extension L. Each rail section 27, 28 comprises two or more telescopically arranged rails 29, 30; 30, 31 and wheels, roller or similar that are running between said rails 29, 30; 30, 31 in a previously well-known manner in order to enable the movement along the first longitudinal extension L. The rail sections 27, 28 are attached to a rail section holder 17 that is attached to the base 16. in this context, the term telescopically means that two or more rails are enabled to move relative each other, at least partially enclosing each other.

It is desirable to have the cover assembly 6 easily removable from the work workpiece support 15 for different reasons. One reason is that the saw assembly 1 according to some aspects is arranged for wet cutting as well, where water is applied to, or in the vicinity of, the saw blade 4 via previously well-known water supply mechanisms, with the intention of retaining dust. Another reason is that it is desirable to have the saw assembly 1 easily dismounted for transport. In accordance to the present disclosure, the cover assembly 6 is therefore releasably attachable to the workpiece support 15, as will be described more in detail in the following.

Figure 6:
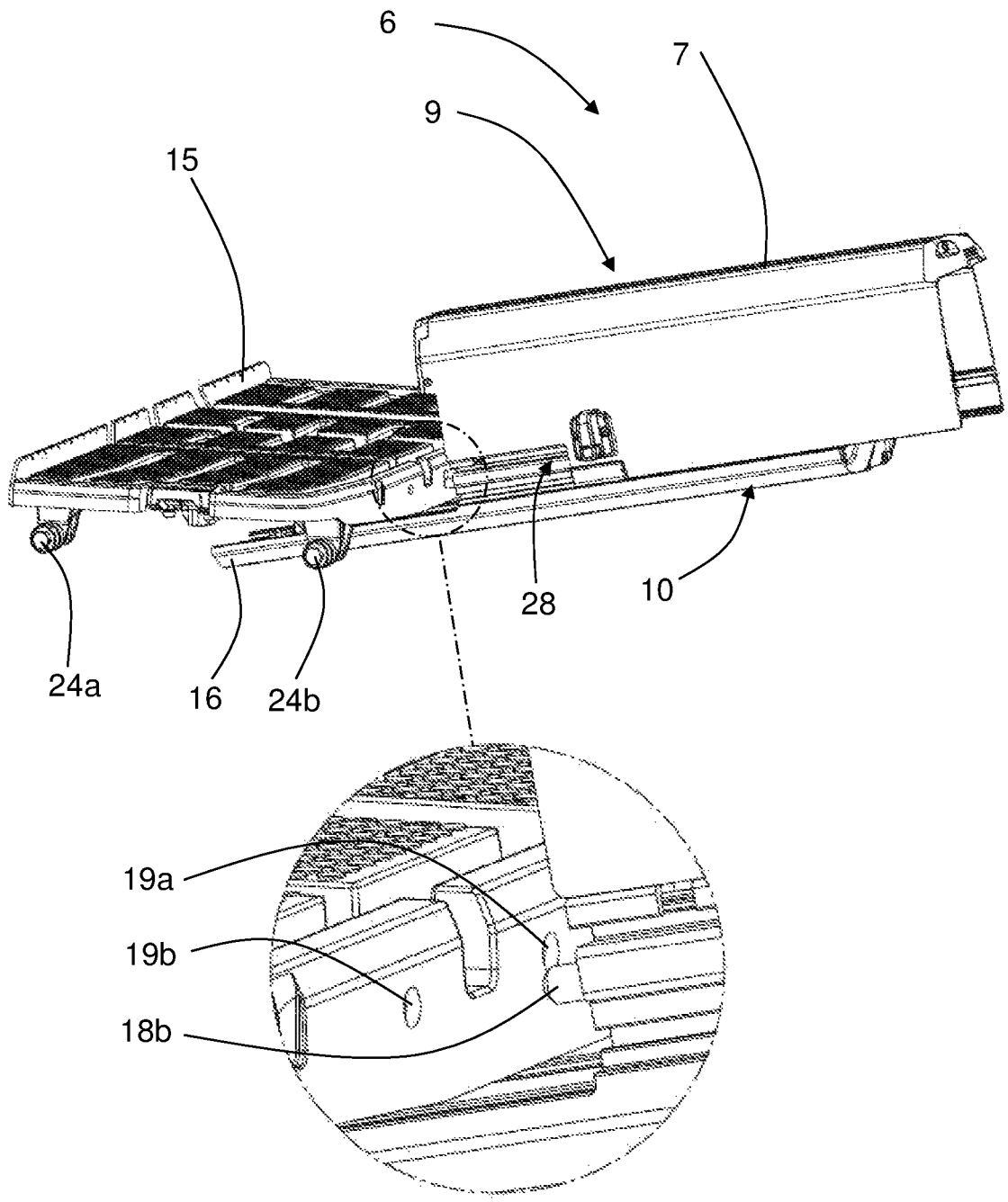
FIG. 6 shows a perspective view of a cover assembly released from a workpiece support.
Figure 7:
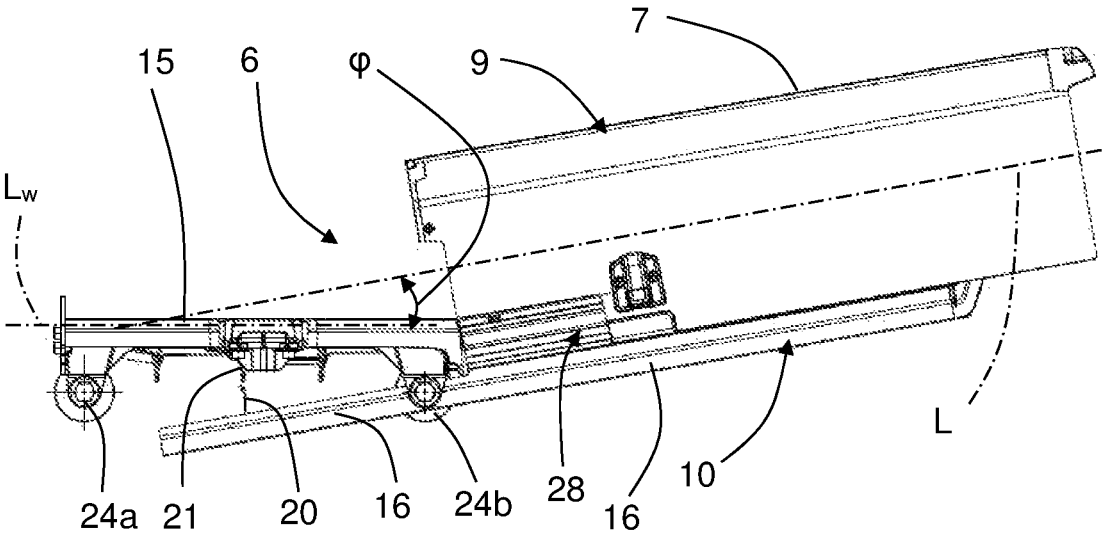
FIG. 7 shows a side view of a cover assembly released from a workpiece support where guiding pins have engaged corresponding apertures.

With reference to FIG. 5 and also to FIG. 6, showing a perspective view of the cover assembly 6 released from the workpiece support 15, the base 16 is arranged to extend beneath the workpiece support 15 when mounted. The rail section holder 17 comprises guiding pins 18*a*. 18*b* that are arranged to engage corresponding apertures 19*a*, 19*b* in the workpiece support 15. Furthermore, with reference also to FIG. 7, showing a side view of the cover assembly 6 still released from the workpiece support 15, but where the guiding pins 18*a*, 18*b* have engaged the apertures 19*a*, 19*b*, the base comprises a resilient tongue part 20 that is arranged to engage a corresponding plate 21 on the workpiece support 15 in a locking manner. For this purpose, as also apparent from FIG. 4 and FIG. 5, the tongue part 20 is folded such that is guided into engagement with the plate 21 when mounted. In this mounting position, the first longitudinal extension L presents an angle φ to a second longitudinal extension $L_w$ of the workpiece support 15.

Figure 8:
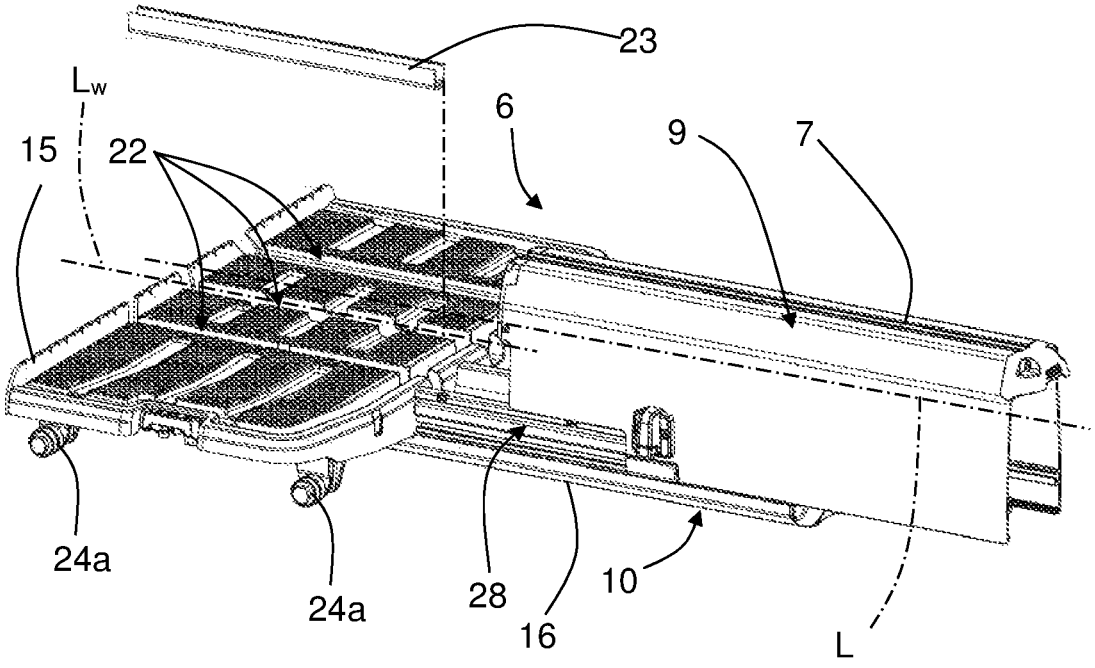
FIG. 8 shows a perspective view of a cover assembly mounted to a workpiece support.

With reference to FIG. 8, showing a perspective view of the cover assembly 6 attached to the workpiece support 15, the workpiece support 15 in this example comprises channels 22 for gathering water that has collected dust when the saw assembly 1 is used for wet cutting. These channels 22 are connected to a drainage system via apertures (not shown) for disposing and/or taking care of the dust-filled water. However, in this dry cutting configuration, when the dust is intended to be conveyed by means of a vacuum dust collection arrangement instead, it is desirable that there are no connections to a drainage system, and therefore separate channel covers 23 (only one shown) are used for covering the channels 22. This means that when the dust is intended to be conveyed by means of the fan device 12 and the cover assembly 6 is attached to the workpiece support 15, the channels 22 are covered with corresponding channel covers 23. In this way, turbulence is reduced, and the dust is more easily guided into the cover assembly 6. According to some aspects, when the cover assembly 6 with its base 16 is attached to the workpiece support 15, the first longitudinal extension L and the second longitudinal extension $L_w$ are parallel to each other.

In FIG. 6, FIG. 7 and FIG. 8, wheels or rollers 24*a*, 24*b* comprised in the workpiece support 15 are shown, these are used for moving the workpiece support 15 along the frame 3, the workpiece support 15 being movably carried by the frame 3 by means of the rollers 24*a*, 24*b* that run in corresponding rails 33*a*, 33*b*, 34*b* in the frame 3, as indicated in FIG. 1, FIG. 2 and FIG. 3.

Figure 9:
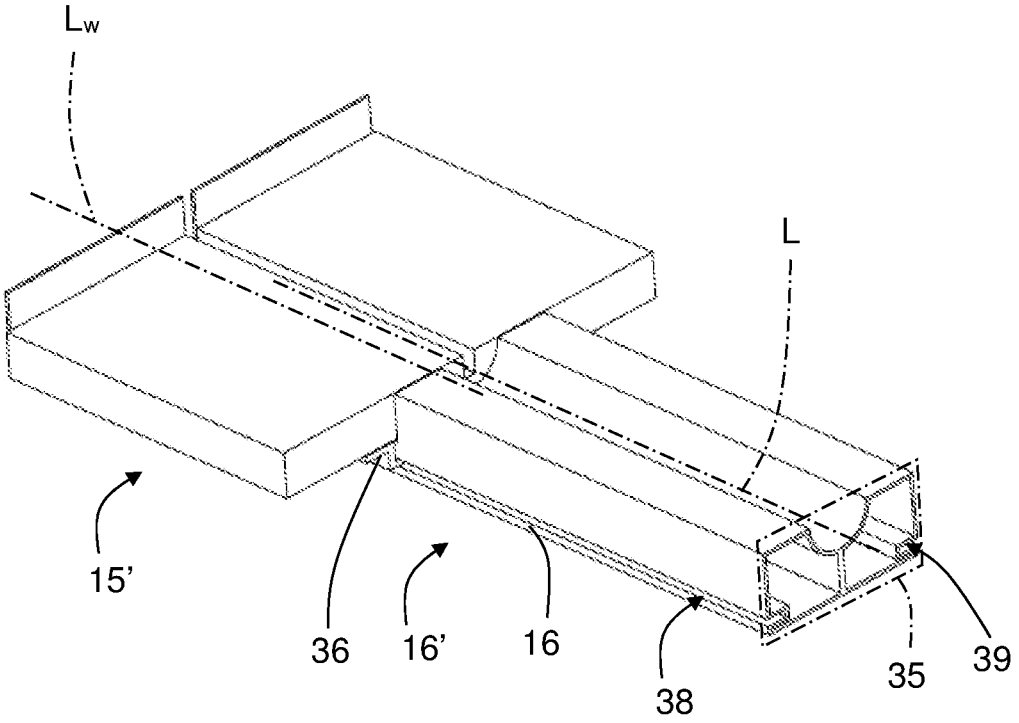
FIG. 9 shows a schematical perspective view of a first further example of how the frame is attached to the workpiece support.
Figure 17:
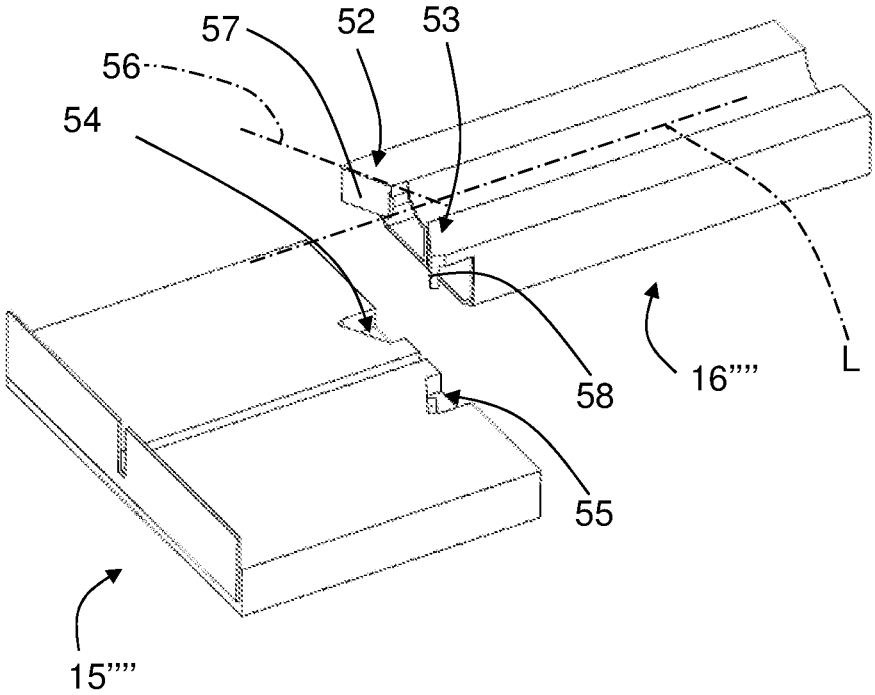
FIG. 17 shows a schematical perspective view of a fourth further example of how the frame is attached to the workpiece support before mounting.

In the following, four further examples for mounting the cover assembly 6 to the workpiece support 15 will be disclosed with reference to FIG. 9 FIG. 17. FIG. 9 FIG. 17 are all of a schematical character, only schematically showing how the base 16 that is comprised in the supporting structure 10 is attached to the workpiece support 15. For reasons of clarity, the cover and rail sections are not shown although these of course are assumed to be present when the cover assembly is completely mounted and ready for use. Furthermore, no wheels or rollers that can be comprised in the workpiece support are shown. In the following, only the base is referred to, although the base is comprised in the supporting structure, since it is the base that is attached to the workpiece support 15.

Figure 10:
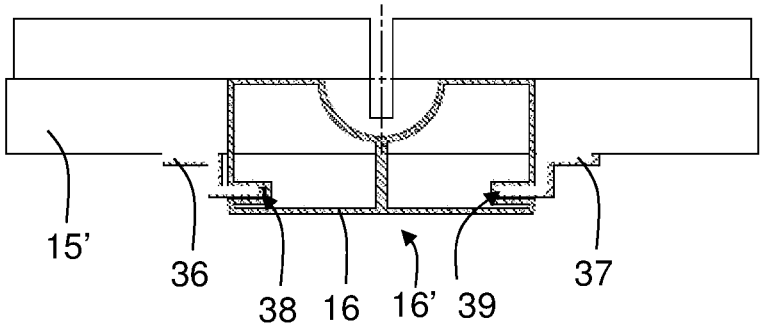
FIG. 10 shows a schematical side sectional view of the arrangement in FIG. 9.

With reference to FIG. 9 and FIG. 10, where FIG. 9 shows a perspective side view with a section plane 35 and FIG. 10 shows a side view towards the section plane 35, the base 16' is attached to the workpiece support 15' by being inserted into longitudinally extending slide holders 36, 37 that are comprised in the workpiece support 15'. In order to enable this attachment, the base 16' comprises longitudinally extending grooves 38, 39, where the slide holders 36, 37 are arranged to slide in the grooves 38, 39, such that the base 16' is fully attached to the workpiece support 15' when the slide holders 36, 37 are fully inserted into the ridges 38, 39.

According to some aspects, as shown in FIG. 9, when the base 16' is attached to the workpiece support 15', the first longitudinal extension L and the second longitudinal extension $L_w$ are parallel to each other.

Figure 11:
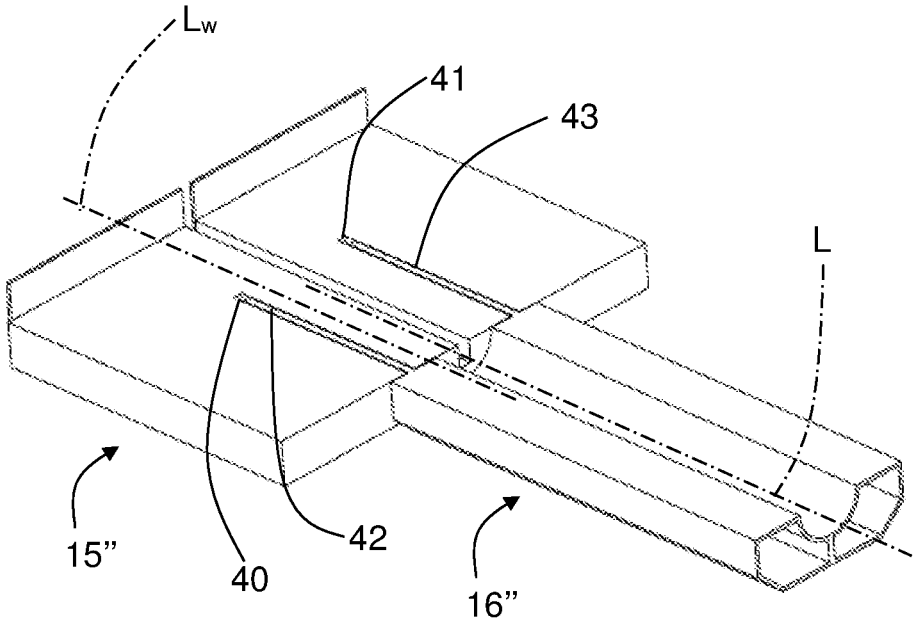
FIG. 11 shows a schematical perspective view of a second further example of how the frame is attached to the workpiece support.
Figure 12:
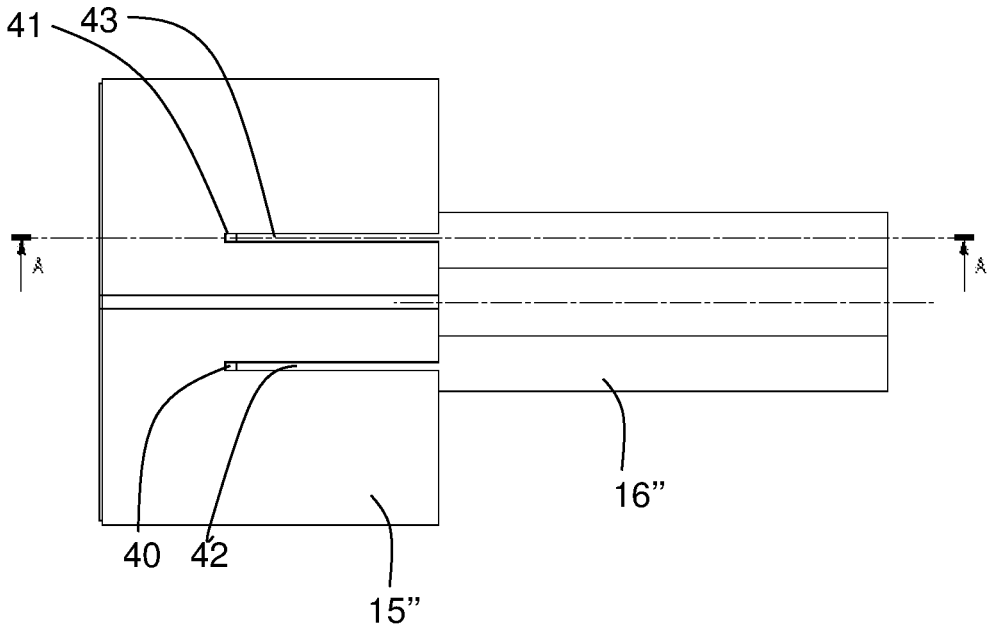
FIG. 12 shows a schematical top view of the arrangement in FIG. 11.
Figure 13:
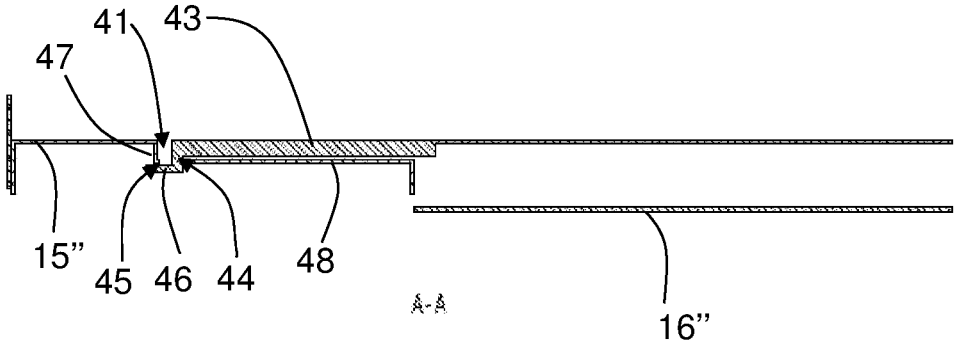
FIG. 13 shows a schematical side sectional view of the arrangement in FIG. 11 and FIG. 12.

With reference to FIG. 11, FIG. 12 and FIG. 13, where FIG. 11 shows a perspective side view, FIG. 12 shows a top view and FIG. 13 shows a sectional view, the workpiece support 15" comprises longitudinally extending grooves 40, 41 and the base 16" comprises longitudinally extending rods 42, 43. As in particular shown in FIG. 13, showing one rod 43 positioned in a corresponding groove 41, the rod comprises a lowered hook part 44 that is inserted in an opening 45 at the end of the groove 41 that is farthest from the rest of the base 16". The hook part 44 comprises a pin 46 that is intended to engage and rest on an end wall part 47 that ends the groove 41. The same arrangement is present for both rods 42, 43.

It is understood from FIG. 13, that when the base 16" is attached to the workpiece support 15", it is inclined such that the pins 46 are allowed to enter opening 45, and then straightened such that the pins 46 can come to rest against the corresponding end wall part 47.

This means that during mounting, the first longitudinal extension L and the second longitudinal extension $L_w$ are parallel to each other. According to some aspects, as shown in FIG. 11, when the base 16" is attached to the workpiece support 15", the first longitudinal extension L and the second longitudinal extension $L_w$ are parallel to each other.

Figure 14:
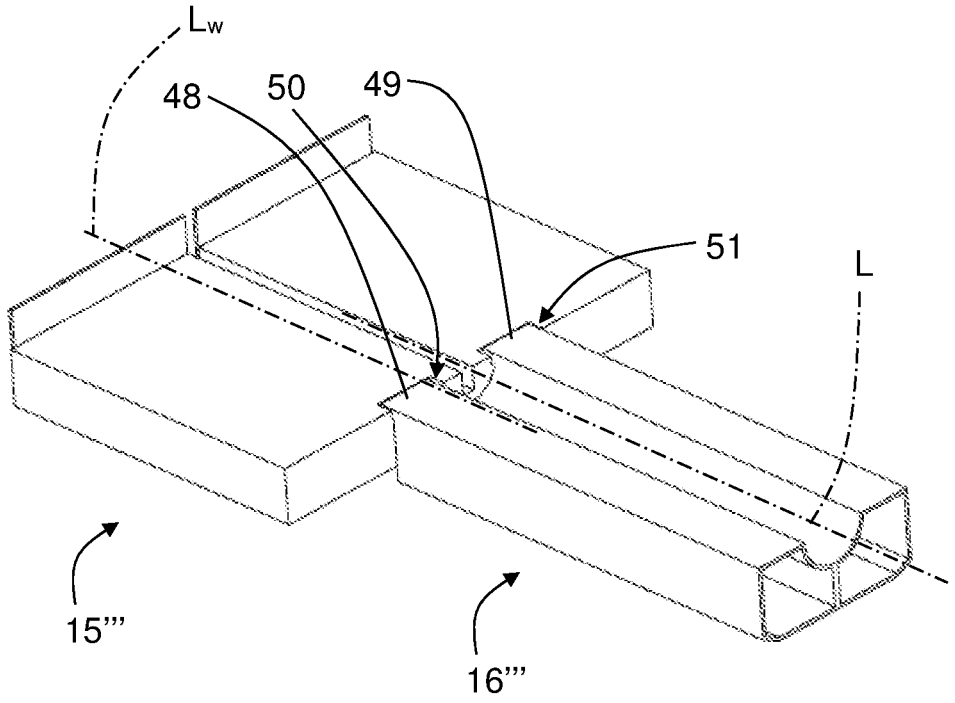
FIG. 14 shows a schematical perspective view of a third further example of how the frame is attached to the workpiece support.
Figure 15:
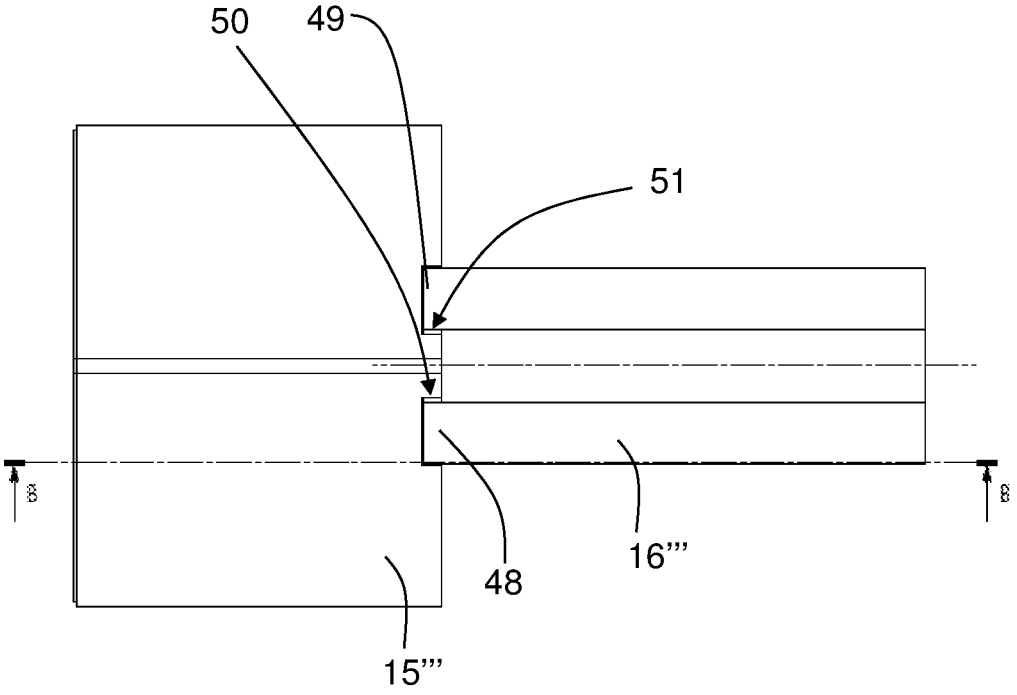
FIG. 15 shows a schematical top view of the arrangement in FIG. 14.
Figure 16:
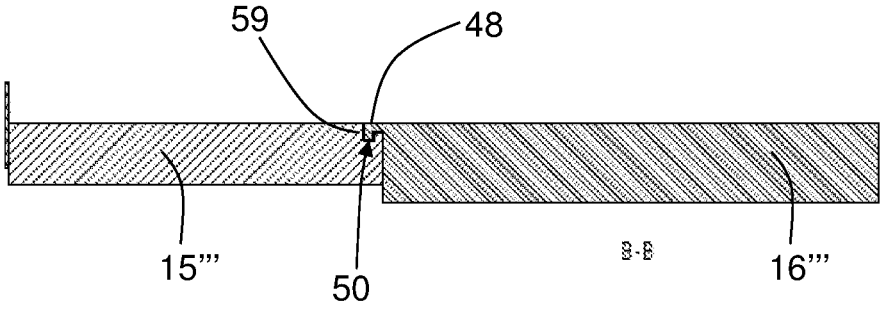
FIG. 16 shows a schematical side sectional view of the arrangement in FIG. 14 and FIG. 15.

With reference to FIG. 14, FIG. 15 and FIG. 16, where FIG. 14 shows a perspective side view, FIG. 15 shows a top view and FIG. 16 shows a sectional view, the workpiece support 15''' comprises two longitudinally protruding hook members 48, 49 that protrude from the end of the base 16''' that is intended to face the workpiece support 15'''. The hook members 48, 49 are intended to engage corresponding indents 50, 51 in the workpiece support 15'''.

It is understood from FIG. 16, that when the base 16''' is attached to the workpiece support 15''', it is inserted from the above, such that the hook members 48, 49 are inserted into the corresponding indents 50, 51. Each hook member 48, 49 comprises a corresponding gripping pin 59 (only one shown in FIG. 16) that is inclined such that it is perpendicular to the rest of the corresponding hook member 48, 49 and can perform a griping attachment to the workpiece support 15'''.

According to some aspects, as shown in FIG. 14, when the base 16''' is attached to the workpiece support 15''', the first longitudinal extension L and the second longitudinal extension $L_w$ are parallel to each other.

Figure 18:
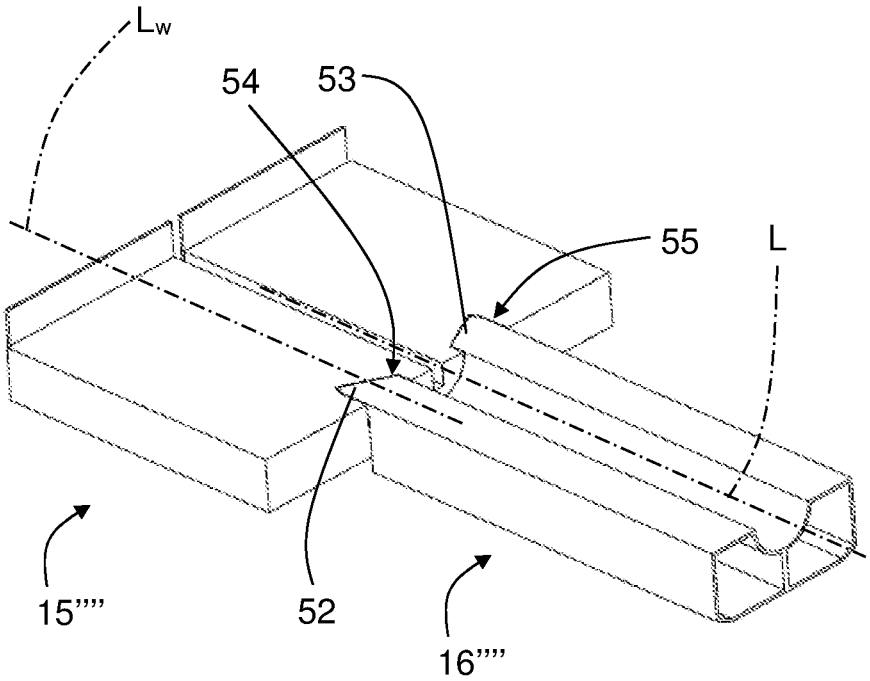
FIG. 18 shows a schematical perspective view of the fourth further example of how the frame is attached to the workpiece support after mounting.

With reference to FIG. 17 and FIG. 18, where FIG. 17 shows a first perspective side view, and FIG. 16 shows a second perspective side view, the workpiece support 15'''' comprises two longitudinally protruding inclined hook members 52, 53 that protrude from the end of the base 16'''' that is intended to face the workpiece support 15''''. The inclined hook members 52, 53 are intended to engage corresponding indents 54, 55 in the workpiece support 15'''' in a similar way as in the previous example. The hook members 52, 53 are inclined with respect to the first longitudinal extension L as indicated with a dash-dotted 56 for one inclined hook member 52 in FIG. 17.

When the base 16'''' is attached to the workpiece support 15'''', it is inserted from the above, such that the inclined hook members 52, 53 are inserted into the corresponding indents 54, 55. Each hook member 52, 53 comprises a corresponding gripping pin 57, 58 that is inclined such that is perpendicular to the rest of the corresponding hook member 52, 53 and can perform a gripping attachment to the workpiece support 15''''.

According to some aspects, as shown in FIG. 18, when the base 16'''' is attached to the workpiece support 15'''', the first longitudinal extension L and the second longitudinal extension $L_w$ are parallel to each other.

For all the above examples, the base 16 is attached to the workpiece support 15 by means of co-operating fastening means comprised in both the base 16 and the workpiece support 15, where these fastening means are intended to engage each other such that the base 16 and the workpiece support 15 both extend straight such that the first longitudinal extension L runs parallel to the second longitudinal extension $L_w$ when the base 16 is attached to the workpiece support 15. This means that the base 16 is fixed to the workpiece support 15 such that no bending or rotating movements are possible, where de-attachment only is possible by performing the attachment procedure in reverse.

The present disclosure is not limited to the examples described above, but may vary freely within the scope of the appended claims. For example, the cover assembly 6 can be attached to the workpiece support 15 in many different ways, the mounting described only being an example of how it can be achieved. It is desired that the mounting is reliable and at the same time easily releasable, for example enabling a quick change between dry cutting and wet cutting.

In this context, expressions such as straight and parallel are not intended to be interpreted as mathematically exact, but within what normally is practically obtainable.

According to some aspects, the cover 9 is attached without rail sections, other arrangements for moving the cover 9 relative the base 16 are conceivable.

According so tome aspects, the cover 9 is attached to the base 16 in a fixed manner.

According to some aspects, no wheels or rollers are comprised in the workpiece support 15, other means for moving the workpiece support 15 relative the frame 3 are conceivable, for example slide rails. Alternatively, the workpiece support 15 is not moveable, being attached to the frame 3 in a fixed manner.

According to some aspects, the cover assembly 6 is attached to the workpiece support 15 in a fixed manner.

According to some aspects, the cover comprises the rail sections 27, 28, not the supporting structure 10.

The base 16 comprises first fastening means and the workpiece support 15 comprises second fastening means as described with reference to FIG. 6-FIG. 18. The respective co-operating first fastening means and second fastening means comprises at least one of:

- one or more guiding pins 18*a*, 18*b* and one or more apertures 19*a*, 19*b* arranged to be engaged by said guiding pins 18*a*, 18*b;*
- at least one resilient tongue part 20 and at least one plate 21 that is arranged to be engaged engage by said tongue part 20;
- grooves 38, 39 and slide holders 36, 37, where the slide holders 36, 37 are arranged to slide in the grooves 38, 39;
- longitudinally extending rods 42, 43 and longitudinally extending grooves 40, 41, where each rod 42, 43 comprises a lowered hook part 44 that is arranged to be inserted in an opening 45 at the end of the groove 41;
- longitudinally protruding hook members 48, 49; 52, 53 and indents 50, 51; 54, 55, where the hook members 48, 49; 52, 53 are intended to be inserted into the indents 50, 51; 54, 55.

Which fastening means that is comprised in the base 16 and which fastening means that is comprised in the workpiece support 15 can of course be varied, the examples provided can for examples have reverse positioned of the fastening means.

Generally, the present disclosure relates to a tile or masonry saw assembly 1 comprising:

- a saw device 2 including a motor 5 arranged to run a saw blade 4 to cut a workpiece in a cutting direction C;
- a frame 3 that is arranged to support the saw device 2 such that it is enabled to move relative to the frame 3 to execute cutting operations by means of the saw blade 4;
- a workpiece support 15 operably coupled to the frame 2 to support the workpiece relative to the saw device 2, and to allow the workpiece support 15 to be moved along the frame 3; and
- a cover assembly 6 that has a first longitudinal extension L and in turn comprises a cover 9 and a supporting structure 10, and has a front end 25 that is arranged to face the saw blade 4 and a rear end that 26 is arranged to face away from the saw blade 4, where the cover assembly 6 comprises a dust hose attachment 11 that is positioned at the rear end 26 and is arranged to be connected to a vacuum dust collection arrangement.

The cover assembly 6 is releasably attachable to the workpiece support 15, where the supporting structure 10 comprises a base 16 that is arranged to be attached to the workpiece support 15.

According to an example, the longitudinal extension L is arranged to run along the cutting direction C when the cover assembly 6 is attached to the workpiece support 15.

According to an example, the workpiece support 15 has a second longitudinal extension $L_w$, where furthermore the base 16 is arranged to be attached to the workpiece support 15 by means of co-operating fastening means comprised in both the base 16 and the workpiece support 15, where these fastening means are intended to engage each other such that the base 16 and the workpiece support 15 both extend straight such that the first longitudinal extension L runs parallel to the second longitudinal extension $L_w$ when the base 16 is attached to the workpiece support 15.

According to an example, the base 16 comprises first fastening means and that the workpiece support 15 comprises second fastening means, where the respective co-operating first fastening means and second fastening means comprises at least one of:

- one or more guiding pins 18*a*, 18*b* and one or more apertures 19*a*, 19*b* arranged to be engaged by said guiding pins 18*a*, 18*b;*
- at least one resilient tongue part 20 and at least one plate 21 that is arranged to be engaged engage by said tongue part 20;
- grooves 38, 39 and slide holders 36, 37, where the slide holders 36, 37 are arranged to slide in the grooves 38, 39;
- longitudinally extending rods 42, 43 and longitudinally extending grooves 40, 41, where each rod 42, 43 comprises a lowered hook part 44 that is arranged to be inserted in an opening 45 at the end of the groove 41;
- longitudinally protruding hook members 48, 49; 52, 53 and indents 50, 51; 54, 55, where the hook members 48, 49; 52, 53 are intended to be inserted into the indents 50, 51; 54, 55.

According to an example, the saw blade 4 is enabled to run in a slot 7 in the cover assembly 6, where the slot 7 is extending in the first longitudinal extension L.

According to an example, the saw assembly 1 comprises releasably attachable channel covers 23 that are adapted to cover water drainage channels comprised in the workpiece support 15.

According to an example, the cover 9 is movable relative the base 16 in the first longitudinal extension L.

According to an example, the cover assembly 6 comprises telescopically extendable rail sections 27, 28 that are attached to the cover 9 and to a rail section holder 17 that is attached to the base 16, these rail sections 27, 28 enabling the cover 9 to move relative the base 16.

Generally, the present disclosure also relates to a tile or masonry saw assembly 1 comprising:

- a saw device 2 including a motor 5 arranged to run a saw blade 4 to cut a workpiece in a cutting direction C;
- a frame 3 that is arranged to support the saw device 2 such that it is enabled to move relative to the frame 3 to execute cutting operations by means of the saw blade 4;
- a workpiece support 15 operably coupled to the frame 2 to support the workpiece relative to the saw device 2, and to allow the workpiece support 15 to be moved along the frame 3; and
- a cover assembly 6 that has a first longitudinal extension L and in turn comprises a cover 9 and a supporting structure 10, and has a front end 25 that is arranged to face the saw blade 4 and a rear end 26 that is arranged to face away from the saw blade 4, where the cover assembly 6 comprises a dust hose attachment 11 that is positioned at the rear end 26 and is arranged to be connected to a vacuum dust collection arrangement.

The supporting structure 10 comprises a base 16 that is arranged to be fastened to the workpiece support 15, where the cover 9 is movable relative the base 16 in the first longitudinal extension L along the cutting direction C.

According to an example, the cover assembly 6 comprises telescopically extendable rail sections 27, 28 that are attached to the cover 9 and to a rail section holder 17 that is attached to the base 16, these rail sections 27, 28 enabling the cover 9 to move relative the base 16.

According to an example, the cover assembly 6 has a first longitudinal extension L along the cutting direction C, where the saw blade 4 is enabled to run in a slot 7 in the cover assembly 6, where the slot 7 is extending in the first longitudinal extension L.

According to an example, the cover assembly 6 is releasably attachable to the workpiece support 15.

According to an example, the workpiece support 15 has a second longitudinal extension $L_w$, where furthermore the base 16 is arranged to be attached to the workpiece support 15 by means of co-operating fastening means comprised in both the base 16 and the workpiece support 15, where these fastening means are intended to engage each other such that the base 16 and the workpiece support 15 both extend straight such that the first longitudinal extension L runs parallel to the second longitudinal extension $L_w$ when the base 16 is attached to the workpiece support 15.

According to an example, the saw assembly 1 comprises releasably attachable channel covers 23 that are adapted to cover water drainage channels comprised in the workpiece support 15.

The invention claimed is:

1. A tile or masonry saw assembly comprising:

a saw device including a motor arranged to run a saw blade to cut a workpiece in a cutting direction;

a frame that is arranged to support the saw device such that the saw device is enabled to move relative to the frame to execute cutting operations by means of the saw blade;

a workpiece support operably coupled to the frame to support the workpiece relative to the saw device, and to allow the workpiece support to be moved along the frame; and a cover assembly that has a first longitudinal extension and in turn comprises a cover and a supporting structure, and has a front end that is arranged to face the saw blade and a rear end that is arranged to face away from the saw blade, where the cover assembly comprises a dust hose attachment that is positioned at the rear end and is arranged to be connected to a vacuum dust collection arrangement;

said cover assembly being releasably attachable to the workpiece support, where the supporting structure comprises a base that is arranged to be attached to the workpiece support;

wherein the cover assembly further comprises a top end that is arranged spaced apart from and parallel to the supporting structure, wherein the top end comprises a slot extending the first longitudinal extension, wherein the saw blade is configured to rotate in the slot such that a portion of the saw blade is in the cover assembly and remaining portions of the saw blade are above the slot and outside of the cover assembly, wherein the workpiece support has a second longitudinal extension, wherein furthermore the base is arranged to be attached to the workpiece support via a co-operating first fastening assembly and second fastening assembly comprised in the base and the workpiece support, respectively, and wherein the first and second fastening assemblies are configured to engage each other such that the base and the workpiece support both extend straight such that the first longitudinal extension runs parallel to the second longitudinal extension when the base is attached to the workpiece support.

2. The saw assembly according to claim 1, the longitudinal extension is arranged to run along the cutting direction when the cover assembly is attached to the workpiece support.

3. The saw assembly according to claim 1, wherein the base comprises the first fastening assembly and the workpiece support comprises the second fastening assembly, wherein the respective co-operating first fastening assembly and second fastening assembly comprises at least one of:

one or more guiding pins and one or more apertures arranged to be engaged by said guiding pins;

at least one resilient tongue part and at least one plate that is arranged to be engaged engage by said tongue part;

grooves and slide holders, wherein the slide holders are arranged to slide in the grooves;

longitudinally extending rods and longitudinally extending grooves, where each rod comprises a lowered hook part that is arranged to be inserted in an opening at the end of the groove;

longitudinally protruding hook members and indents, wherein the hook members are intended to be inserted into the indents.

4. The saw assembly according to claim 1, wherein the saw blade is enabled to run in the slot in the cover assembly, where the slot is extending in the first longitudinal extension.

5. The saw assembly according to claim 1, wherein the cover is movable relative the base in the first longitudinal extension.

6. The saw assembly according to claim 5, wherein the cover assembly comprises telescopically extendable rail sections that are attached to the cover and to a rail section holder that is attached to the base, the rail sections enabling the cover to move relative the base.

7. A tile or masonry saw assembly comprising:

a saw device including a motor arranged to run a saw blade to cut a workpiece in a cutting direction;

a frame that is arranged to support the saw device such that the saw device is enabled to move relative to the frame to execute cutting operations by means of the saw blade;

a workpiece support operably coupled to the frame to support the workpiece relative to the saw device, and to allow the workpiece support to be moved along the frame; and a cover assembly that has a first longitudinal extension and in turn comprises a cover and a supporting structure, and has a front end that is arranged to face the saw blade and a rear end that is arranged to face away from the saw blade, where the cover assembly comprises a dust hose attachment that is positioned at the rear end and is arranged to be connected to a vacuum dust collection arrangement;

said cover assembly being releasably attachable to the workpiece support, where the supporting structure comprises a base that is arranged to be attached to the workpiece support;

wherein the workpiece support has a second longitudinal extension, wherein furthermore the base is arranged to be attached to the workpiece support via a co-operating first fastening assembly and second fastening assembly comprised in the base and the workpiece support, respectively, wherein the first and second fastening assemblies are configured to engage each other such that the base and the workpiece support both extend straight such that the first longitudinal extension runs parallel to the second longitudinal extension when the base is attached to the workpiece support, and wherein the saw assembly comprises releasably attachable channel covers that are adapted to cover water drainage channels comprised in the workpiece support.

8. A tile or masonry saw assembly comprising:

a saw device including a motor arranged to run a saw blade to cut a workpiece in a cutting direction;

a frame that is arranged to support the saw device such that the saw device is enabled to move relative to the frame to execute cutting operations by means of the saw blade;

a workpiece support operably coupled to the frame to support the workpiece relative to the saw device, and to allow the workpiece support to be moved along the frame; and a cover assembly that has a first longitudinal extension and in turn comprises a cover and a supporting structure, and has a front end that is arranged to face the saw blade and a rear end that is arranged to face away from the saw blade, wherein the cover assembly comprises a dust hose attachment that is positioned at the rear end and is arranged to be connected to a vacuum dust collection arrangement;

wherein the supporting structure comprises a base that is arranged to be fastened to the workpiece support, where the cover is movable relative the base in the first longitudinal extension along the cutting direction, wherein the cover assembly further comprises a top end that is arranged spaced apart from and parallel to the supporting structure, wherein the top end comprises a slot extending the first longitudinal extension, wherein the saw blade is configured to rotate in the slot such that a portion of the saw blade is in the cover assembly and remaining portions of the saw blade are above the slot and outside of the cover assembly.

9. The saw assembly according to claim 8, wherein the cover assembly comprises telescopically extendable rail sections that are attached to the cover and to a rail section holder that is attached to the base, the rail sections enabling the cover to move relative the base.

10. The saw assembly according to claim 8, wherein the cover assembly is releasably attachable to the workpiece support.

11. The saw assembly according to claim 10, wherein the workpiece support has a second longitudinal extension wherein furthermore the base is arranged to be attached to the workpiece support by means of a co-operating first fastening assembly and second fastening assembly comprised in both the base and the workpiece support, these first and second fastening assemblies are configured to engage each other such that the base and the workpiece support both extend straight such that the first longitudinal extension runs parallel to the second longitudinal extension when the base is attached to the workpiece support.

12. The saw assembly according to claim 8, wherein the saw assembly comprises releasably attachable channel covers that are adapted to cover water drainage channels comprised in the workpiece support.

* * * * *